US010242633B2

(12) United States Patent
Park et al.

(10) Patent No.: US 10,242,633 B2
(45) Date of Patent: Mar. 26, 2019

(54) DISPLAY PANEL AND A DISPLAY APPARATUS INCLUDING THE SAME

(71) Applicant: SAMSUNG DISPLAY CO., LTD., Yongin, Gyeonggi-do (KR)

(72) Inventors: Se-Hyuk Park, Hwaseong-si (KR); Byung-Sun Kim, Suwon-si (KR); Cheol-Woo Park, Suwon-si (KR); Jae-Hyun Cho, Seoul (KR); Bon-Seog Gu, Seongnam-si (KR); Hong-Soo Kim, Anyang-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 221 days.

(21) Appl. No.: 14/803,356

(22) Filed: Jul. 20, 2015

(65) Prior Publication Data

US 2016/0225330 A1 Aug. 4, 2016

(30) Foreign Application Priority Data

Feb. 3, 2015 (KR) ..... 10-2015-0016852

(51) Int. Cl.
*G09G 3/36* (2006.01)

(52) U.S. Cl.
CPC ..... *G09G 3/3607* (2013.01); *G09G 3/3614* (2013.01); *G09G 3/3648* (2013.01);
(Continued)

(58) Field of Classification Search
CPC ... G09G 2300/0426; G09G 2300/0452; G09G 2310/0218; G09G 2310/08; G09G 3/3607;
(Continued)

(56) References Cited

U.S. PATENT DOCUMENTS

2002/0186190 A1* 12/2002 Janssen ..... G09G 3/3648 345/87
2012/0262431 A1* 10/2012 Cheng ..... G09G 3/3614 345/204

(Continued)

FOREIGN PATENT DOCUMENTS

EP 1492078 12/2004
KR 1020090071086 7/2009

(Continued)

OTHER PUBLICATIONS

EPO Search Report dated Jul. 5, 2016 in the corresponding European Patent Application No. 16154075.2.

*Primary Examiner* — Kwin Xie
(74) *Attorney, Agent, or Firm* — F. Chau & Associates, LLC

(57) ABSTRACT

A display panel includes gate lines, data lines, and pixels. The gate lines extend in a first direction and include first and second gate lines adjacent to each other. The data lines extend in a second direction crossing the first direction and include first to third data lines. Each of the pixels is connected to one of the gate lines and one of the data lines. The first data line is connected to at least a first any one of a second plurality of pixels in a first pixel column of the pixels. The second data line is connected to at least a first any one of a first plurality of pixels in the first pixel column. The third data line is connected to at least a second any one of the first plurality of pixels and at least a second any one of the second plurality of pixels.

19 Claims, 7 Drawing Sheets

(52) U.S. Cl.
CPC ..... *G09G 3/3677* (2013.01); *G09G 3/3685* (2013.01); *G09G 3/3688* (2013.01); *G09G 2300/0426* (2013.01); *G09G 2300/0452* (2013.01); *G09G 2310/0218* (2013.01); *G09G 2310/08* (2013.01); *G09G 2320/0223* (2013.01)

(58) Field of Classification Search
CPC ... G09G 3/3614; G09G 3/3648; G09G 3/3677
USPC ..... 345/690, 87–104
See application file for complete search history.

(56) References Cited

U.S. PATENT DOCUMENTS

2013/0027439 A1* 1/2013 Kim ..... G09G 3/003 345/690
2013/0063667 A1* 3/2013 Sakai ..... G09G 3/3648 348/731
2013/0222216 A1* 8/2013 Park ..... G09G 3/3614 345/55
2013/0256707 A1* 10/2013 Chiang ..... H01L 33/08 257/88
2014/0160096 A1* 6/2014 Li ..... G02F 1/13454 345/204
2015/0009106 A1* 1/2015 Lee ..... G09G 3/3233 345/77
2015/0187301 A1* 7/2015 Yoon ..... G09G 3/36 345/88

FOREIGN PATENT DOCUMENTS

KR 1020090099287 9/2009
KR 1020120074919 7/2012
KR 1020140090715 7/2014

* cited by examiner

DISPLAY PANEL AND A DISPLAY APPARATUS INCLUDING THE SAME

CROSS-REFERENCE TO RELATED APPLICATION

This application claims priority under 35 U.S.C. § 119 to Korean Patent Application No. 10-2015-0016852, filed on Feb. 3, 2015, in the Korean Intellectual Property Office (KIPO), the disclosure of which is incorporated by reference herein in its entirety.

TECHNICAL FIELD

Exemplary embodiments of the present inventive concept relate to a display apparatus, and more particularly to, a display panel and a display apparatus including the display panel.

DISCUSSION OF THE RELATED ART

A liquid crystal display (LCD) apparatus may include a first substrate including a pixel electrode, a second substrate including a common electrode, and a liquid crystal layer disposed between the first and second substrates. Voltages may be applied to the pixel electrode and the common electrode to generate an electric field. Transmittance of light passing through the liquid crystal layer may be controlled according to the electric field, and thus, a desired image may be displayed.

Since the number of horizontal rows increases as a display resolution or a size of the LCD apparatus increases, a driving scheme for securing a pixel charging duration may be employed.

SUMMARY

According to an exemplary embodiment of the present inventive concept, a display panel is provided. The display panel includes a plurality of gate lines, a plurality of data lines, and a plurality of pixels. The plurality of gate lines extends in a first direction, and the plurality of gate lines includes a first gate line and a second gate line that are adjacent to each other. The plurality of data lines extends in a second direction crossing the first direction, and the plurality of data lines includes a first data line, a second data line, and a third data line. The plurality of pixels is connected to at least one of the plurality of gate lines and at least one of the plurality of data lines. The first data line is connected to at least a first any one of a second plurality of pixels in a first pixel column of the plurality of pixels. The second data line is connected to at least a first any one of a first plurality of pixels in the first pixel column. The third data line is connected to at least a second any one of the first plurality of pixels and at least a second any one of the second plurality of pixels.

In an exemplary embodiment of the present inventive concept, the plurality of data lines may further include a fourth data line and a fifth data line. The second data line may be connected to at least a first any one of a fourth plurality of pixels in a second pixel column of the plurality of pixels. The fourth data line may be connected to at least a first any one of a third plurality of pixels in the second pixel column. The fifth data line may be connected to at least a second any one of the third plurality of pixels and at least a second any one of the fourth plurality of pixels.

In an exemplary embodiment of the present inventive concept, the plurality of data lines may further include a fourth data line. The third data line and the fourth data line may be disposed between the first and second data lines. The first plurality of pixels may include a first pixel, a second pixel, and a third pixel that are sequentially disposed in the second direction. The second plurality of pixels may include a fourth pixel, a fifth pixel, and a sixth pixel that are sequentially disposed in the second direction. The first and fifth pixels may be connected to the third data line. The second and sixth pixels may be connected to the fourth data line. The third pixel may be connected to the second data line. The fourth pixel may be connected to the first data line.

In an exemplary embodiment of the present inventive concept, the third pixel and the fourth pixel may be adjacent to each other, and a first data voltage applied to the third pixel may have a polarity different from a polarity of a second data voltage applied to the fourth pixel.

In an exemplary embodiment of the present inventive concept, data voltages having a first polarity may be applied to the first data line and the fourth data line. Data voltages having a second polarity different from the first polarity may be applied to the second data line and the third data line.

In an exemplary embodiment of the present inventive concept, the first polarity may be a positive polarity with respect to a common voltage, and the second polarity may be a negative polarity with respect to the common voltage.

In an exemplary embodiment of the present inventive concept, the first polarity may be a negative polarity with respect to a common voltage, and the second polarity may be a positive polarity with respect to the common voltage.

In an exemplary embodiment of the present inventive concept, the plurality of data lines may further include a fourth data line, a fifth data line, and a sixth data line. The third, seventh, eighth, and ninth data lines may be disposed between the first and second data lines. The first plurality of pixels may include a first pixel, a second pixel, a third pixel, a fourth pixel, and a fifth pixel that are sequentially disposed in the second direction, and the second plurality of pixels may include a sixth pixel, a seventh pixel, an eighth pixel, a ninth pixel, and a tenth pixel that are sequentially disposed in the second direction. The first and seventh pixels may be connected to the third data line. The second and eighth pixels may be connected to the fourth data line. The third and ninth pixels may be connected to the fifth data line. The fourth and tenth pixels may be connected to the sixth data line. The fifth pixel may be connected to the second data line. The sixth pixel may be connected to the first data line.

In an exemplary embodiment of the present inventive concept, the plurality of pixels may include a red pixel outputting a red light, a green pixel outputting a green light, and a blue pixel outputting a blue light.

According to an exemplary embodiment of the present inventive concept, a display apparatus is provided. The display apparatus includes a display panel and a timing controller. The timing controller is configured to control an operation of a display panel and to generate output image data based on input image data. The display panel displays an image based on the output image data. The display panel includes a plurality of gate lines, a plurality of data lines, and a plurality of pixels. The plurality of gate lines extends in a first direction, and the plurality of gate lines includes a first gate line and a second gate line that are adjacent to each other. The plurality of data lines extends in a second direction crossing the first direction, and the plurality of data lines includes a first data line, a second data line, and a third data line. The plurality of pixels is connected to at least one of the plurality of gate lines and at least one of the plurality of data lines. The first data line is connected to at least a first any one of a second plurality of pixels in a first pixel column of the plurality of pixels. The second data line is connected to at least a first any one of a first plurality of pixels in the first pixel column. The third data line is connected to at least a second any one of the first plurality of pixels and at least a second any one of the second plurality of pixels.

In an exemplary embodiment of the present inventive concept, the plurality of data lines may further include a fourth data line and a fifth data line. The second data line may be connected to at least a first any one of a fourth plurality of pixels in a second pixel column of the plurality of pixels. The fourth data line may be connected to at least a first any one of a third plurality of pixels in the second pixel column. The fifth data line may be connected to at least a second any one of the third plurality of pixels and at least a second any one of the fourth plurality of pixels.

In an exemplary embodiment of the present inventive concept, the plurality of data lines may further include a fourth data line. The third data line and the fourth data line may be disposed between the first and second data lines. The first plurality of pixels may include a first pixel, a second pixel, and a third pixel that are sequentially disposed in the second direction. The second plurality of pixels may include a fourth pixel, a fifth pixel, and a sixth pixel that are sequentially disposed in the second direction. The first and fifth pixels may be connected to the third data line. The second and sixth pixels may be connected to the fourth data line. The third pixel may be connected to the second data line. The fourth pixel may be connected to the first data line.

In an exemplary embodiment of the present inventive concept, the third pixel and the fourth pixel may be adjacent to each other, and a first data voltage applied to the third pixel may have a polarity different from a polarity of a second data voltage applied to the fourth pixel.

In an exemplary embodiment of the present inventive concept, data voltages having a first polarity may be applied to the first data line and the fourth data line. Data voltages having a second polarity different from the first polarity may be applied to the second data line and the third data line.

In an exemplary embodiment of the present inventive concept, the first polarity may be a positive polarity with respect to a common voltage, and the second polarity may be a negative polarity with respect to the common voltage.

In an exemplary embodiment of the present inventive concept, the first polarity may be a negative polarity with respect to a common voltage, and the second polarity may be a positive polarity with respect to the common voltage.

In an exemplary embodiment of the present inventive concept, the plurality of data lines may further include a fourth data line, a fifth data line, and a sixth data line. The third, seventh, eighth, and ninth data lines may be disposed between the first and second data lines. The first plurality of pixels may include a first pixel, a second pixel, a third pixel, a fourth pixel, and a fifth pixel that are sequentially disposed in the second direction, and the second plurality of pixels may include a sixth pixel, a seventh pixel, an eighth pixel, a ninth pixel, and a tenth pixel that are sequentially disposed in the second direction. The first and seventh pixels may be connected to the third data line. The second and eighth pixels may be connected to the fourth data line. The third and ninth pixels may be connected to the fifth data line. The fourth and tenth pixels may be connected to the sixth data line. The fifth pixel may be connected to the second data line. The sixth pixel may be connected to the first data line.

In an exemplary embodiment of the present inventive concept, the plurality of pixels may include a red pixel outputting a red light, a green pixel outputting a green light, and a blue pixel outputting a blue light.

In an exemplary embodiment of the present inventive concept, the display apparatus may further include a gate driver. The gate driver may be connected to the plurality of gate lines and may generate a plurality of gate signals to be applied to the display panel.

In an exemplary embodiment of the present inventive concept, the display apparatus may further include a data driver. The data driver may be connected to the plurality of data lines and may generate a plurality of data voltages based on the output image data to be applied to the display panel.

According to an exemplary embodiment of the present inventive concept, a display panel is provided. The display panel includes a plurality of data lines and a plurality of pixels. The plurality of data lines includes a first data line, a second data line, and a third data line. The plurality of pixels includes a first plurality of pixels arranged in a first pixel column, a second plurality of pixels arranged in the first pixel column, a third plurality of pixels arranged in a second pixel column, and a fourth plurality of pixels arranged in the second pixel column. The first data line is connected to at least a first any one of the second plurality of pixels. The second data line is connected to at least a first any one of the first plurality of pixels. The third data line is connected to at least a second any one of the first plurality of pixels and at least a second any one of the second plurality of pixels. The third data line is disposed between the first and second data lines.

BRIEF DESCRIPTION OF THE DRAWINGS

Illustrative, non-limiting exemplary embodiments of the present inventive concept will be more clearly understood from the following detailed description taken in conjunction with the accompanying drawings, in which.

DETAILED DESCRIPTION OF THE EMBODIMENTS

Figure 1:
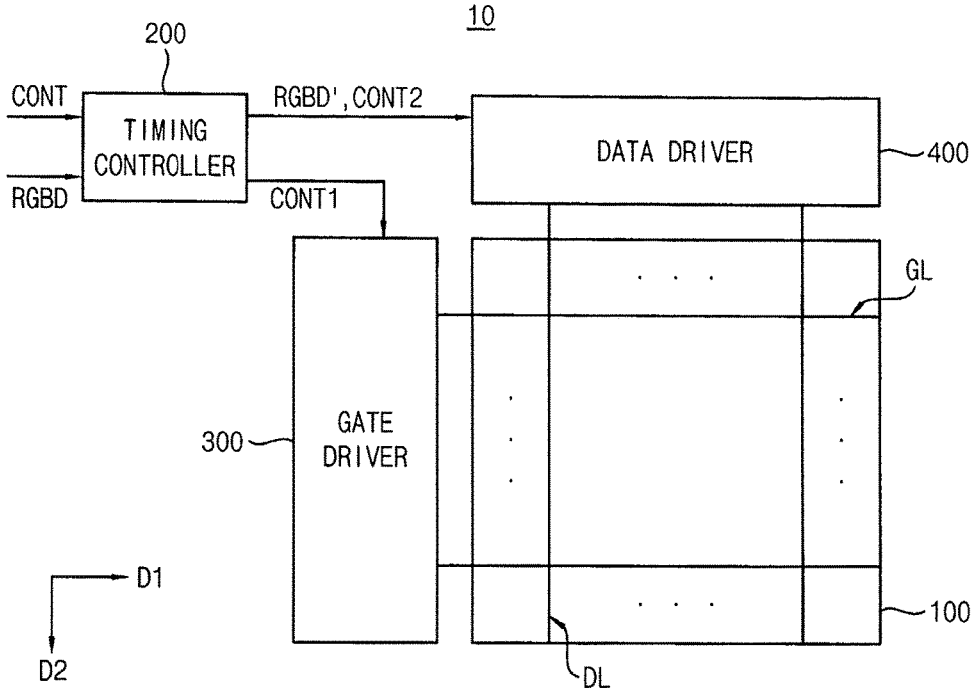
FIG. 1 is a block diagram illustrating a display apparatus according to an exemplary embodiment of the present inventive concept.

Exemplary embodiments of the present inventive concept will be described more fully with reference to the accompanying drawings. The present inventive concept may, however, be embodied in many different forms and should not be construed as being limited to the embodiments set forth herein. Like reference numerals may refer to like elements throughout this application.

As used herein, the term "and/or" includes any and all combinations of one or more of the associated listed items.

It will be understood that when an element is referred to as being "connected" or "coupled" to another element, it can be directly connected or coupled to the other element or intervening elements may be present.

As used herein, the singular forms "a," "an" and "the" are intended to include the plural forms as well, unless the context clearly indicates otherwise.

FIG. 1 is a block diagram illustrating a display apparatus according to an exemplary embodiment of the present inventive concept.

Referring to FIG. 1, a display apparatus 10 includes a display panel 100, a timing controller 200, a gate driver 300 and a data driver 400.

The display panel 100 is connected to a plurality of gate lines GL and a plurality of data lines DL. The display panel 100 displays an image having a plurality of grayscales based on output image data RGBD'. The gate lines GL may extend in a first direction D1, and the data lines DL may extend in a second direction D2 crossing (e.g., substantially perpendicular to) the first direction D1.

The display panel 100 may include a plurality of pixels that is arranged in a matrix form. Each pixel may be electrically connected to a respective one of the gate lines GL and a respective one of the data lines DL.

Each pixel may include a switching element, a liquid crystal capacitor and a storage capacitor. The liquid crystal capacitor and the storage capacitor may be electrically connected to the switching element. For example, the switching element may be a thin film transistor. The liquid crystal capacitor may include a first electrode connected to a pixel electrode and a second electrode connected to a common electrode. A data voltage may be applied to the first electrode of the liquid crystal capacitor. A common voltage may be applied to the second electrode of the liquid crystal capacitor. The storage capacitor may include a first electrode connected to the pixel electrode and a second electrode connected to a storage electrode. The data voltage may be applied to the first electrode of the storage capacitor. A storage voltage may be applied to the second electrode of the storage capacitor. The storage voltage may be substantially equal to the common voltage.

Each pixel may have a rectangular shape. For example, each pixel may have a relatively short side in the first direction D1 and a relatively long side in the second direction D2. The relatively short side of each pixel may be substantially parallel to the gate lines GL. The relatively long side of each pixel may be substantially parallel to the data lines DL.

The display panel 100 according to an exemplary embodiment of the present inventive concept may operate based on an inversion driving scheme in which a polarity of a data voltage applied to each pixel is reversed with respect to the common voltage at every predetermined period. Thus, characteristic of the liquid crystal in the display panel 100 might not be degraded due to the inversion driving scheme. For example, the display panel 100 may have a polarity pattern of a dot inversion where a single pixel is surrounded by pixels having a polarity, which is opposite to that of the single pixel.

In the display panel 100 according to an exemplary embodiment of the present inventive concept, a plurality of horizontal rows (e.g., pixel rows) may be driven by a single gate line. For example, pixels that are disposed in odd-numbered (e.g., three, five, seven, . . . ) adjacent pixel rows may be connected to a single gate line and may be enabled or disabled by the single gate line, and thus, charging durations of the pixels (e.g., charging durations of the capacitors included in the pixels) may increase.

In addition, the display panel 100 according to an exemplary embodiment of the present inventive concept may have a structure where the data lines are connected to pixels based on a non-alternate scheme and an alternate scheme. The non-alternate scheme may be understood as a scheme in which a particular data line is connected to pixels disposed at a single side (e.g., only a left side or a right side) with respect to the particular data line. The alternate scheme may be understood as a scheme in which a particular data line is connected to pixels disposed at both sides (e.g., both left and right sides) with respect to the particular data line. For example, some of the data lines DL in the display panel 100 may be implemented based on the non-alternate scheme, and the other of the data lines DL in the display panel 100 may be implemented based on the alternate scheme. To have the structure in which the data lines are connected to the pixels based on the non-alternate scheme and the alternate scheme, the display panel 100 according to an exemplary embodiment of the present inventive concept may further include at least one data line in comparison with another display panel.

Detailed configurations and arrangements of the display panel 100 and the pixels included in the display panel 100 will be described below with reference to FIGS. 3 through 6.

The timing controller 200 controls operations of the display panel 100, the gate driver 300, and the data driver 400. The timing controller 200 receives input image data RGBD and an input control signal CONT from an external device (e.g., a host). The input image data RGBD may include a plurality of input pixel data for the plurality of pixels. Each input pixel data may include red grayscale data R, green grayscale data G and blue grayscale data B for a respective one of the plurality of pixels. The input control signal CONT may include a master clock signal, a data enable signal, a vertical synchronization signal, a horizontal synchronization signal, etc.

The timing controller 200 generates the output image data RGBD', a first control signal CONT1 and a second control signal CONT2 based on the input image data RGBD and the input control signal CONT.

For example, the timing controller 200 may generate the output image data RGBD' based on the input image data RGBD. The output image data RGBD' may be provided to the data driver 400. In some exemplary embodiment of the present inventive concept, the output image data RGBD' may be image data that is substantially the same as the input image data RGBD. In an exemplary embodiment of the present inventive concept, the output image data RGBD' may be compensated image data that is generated by compensating the input image data RGBD. The output image data RGBD' may include a plurality of output pixel data for the plurality of pixels.

The timing controller 200 may generate the first control signal CONT1 based on the input control signal CONT. The first control signal CONT1 may be provided to the gate driver 300, and a driving timing of the gate driver 300 may be controlled based on the first control signal CONT1. The first control signal CONT1 may include a vertical start signal, a gate clock signal, etc. The timing controller 200 may generate the second control signal CONT2 based on the input control signal CONT. The second control signal CONT2 may be provided to the data driver 400, and a driving timing of the data driver 400 may be controlled based on the second control signal CONT2. The second control signal CONT2 may include a horizontal start signal, a data clock signal, a data load signal, a polarity control signal, etc.

The gate driver 300 receives the first control signal CONT1 from the timing controller 200. The gate driver 300 generates a plurality of gate signals for driving the gate lines GL based on the first control signal CONT1. The gate driver 300 may sequentially apply the plurality of gate signals to the gate lines GL.

The data driver 400 receives the second control signal CONT2 and the output image data RGBD' from the timing controller 200. The data driver 400 generates a plurality of data voltages (e.g., analog data voltages) based on the second control signal CONT2 and the output image data RGBD' (e.g., digital image data). The data driver 400 may apply the plurality of data voltages to the data lines DL.

In some exemplary embodiment of the present inventive concept, the data driver 400 may include a shift register, a latch, a signal processor and a buffer. The shift register may output a latch pulse to the latch. The latch may temporarily store the output image data RGBD', and may output the output image data RGBD' to the signal processor. The signal processor may generate the analog data voltages based on the digital output image data RGBD' and may output the analog data voltages to the buffer. The buffer may output the analog data voltages to the data lines DL.

In some exemplary embodiment of the present inventive concept, the gate driver 300 and/or the data driver 400 may be disposed, e.g., directly mounted, on the display panel 100, or may be connected to the display panel 100 in a tape carrier package (TCP) type. In an exemplary embodiment of the present inventive concept, the gate driver 300 and/or the data driver 400 may be integrated in the display panel 100.

Figure 2:
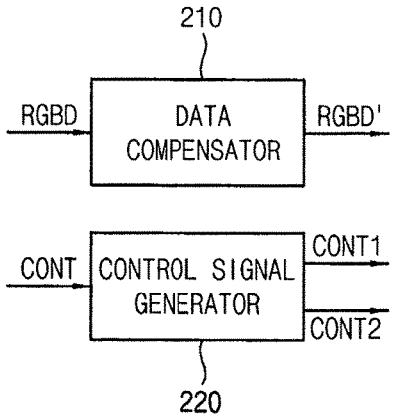
FIG. 2 is a block diagram illustrating a timing controller included in the display apparatus of FIG. 1 according to an exemplary embodiment of the present inventive concept.

FIG. 2 is a block diagram illustrating a timing controller included in the display apparatus of FIG. 1 according to an exemplary embodiment of the present inventive concept.

Referring to FIG. 2, the timing controller 200 may include a data compensator 210 and a control signal generator 220. The timing controller 200 is illustrated in FIG. 2 as being divided into two elements for convenience of description, however, the timing controller 200 may not be physically divided.

The data compensator 210 may receive the input image data RGBD from an external device and may generate the output image data RGBD' by selectively compensating the input image data RGBD. For example, the data compensator 210 may selectively perform an image quality compensation, a spot compensation, an adaptive color correction (ACC), and/or a dynamic capacitance compensation (DCC) for the input image data RGBD to generate the output image data RGBD'.

In some exemplary embodiment of the present inventive concept, the data compensator 210 may include a single-line memory that stores pixel data corresponding to a single horizontal row (e.g., a single pixel row).

The control signal generator 220 may receive the input control signal CONT from an external device and may generate the first control signal CONT1 for the gate driver 300 in FIG. 1 and the second control signal CONT2 for the data driver 400 in FIG. 1 based on the input control signal CONT. The control signal generator 220 may output the first control signal CONT1 to the gate driver 300 in FIG. 1 and may output the second control signal CONT2 to the data driver 400 in FIG. 1.

Figure 3:
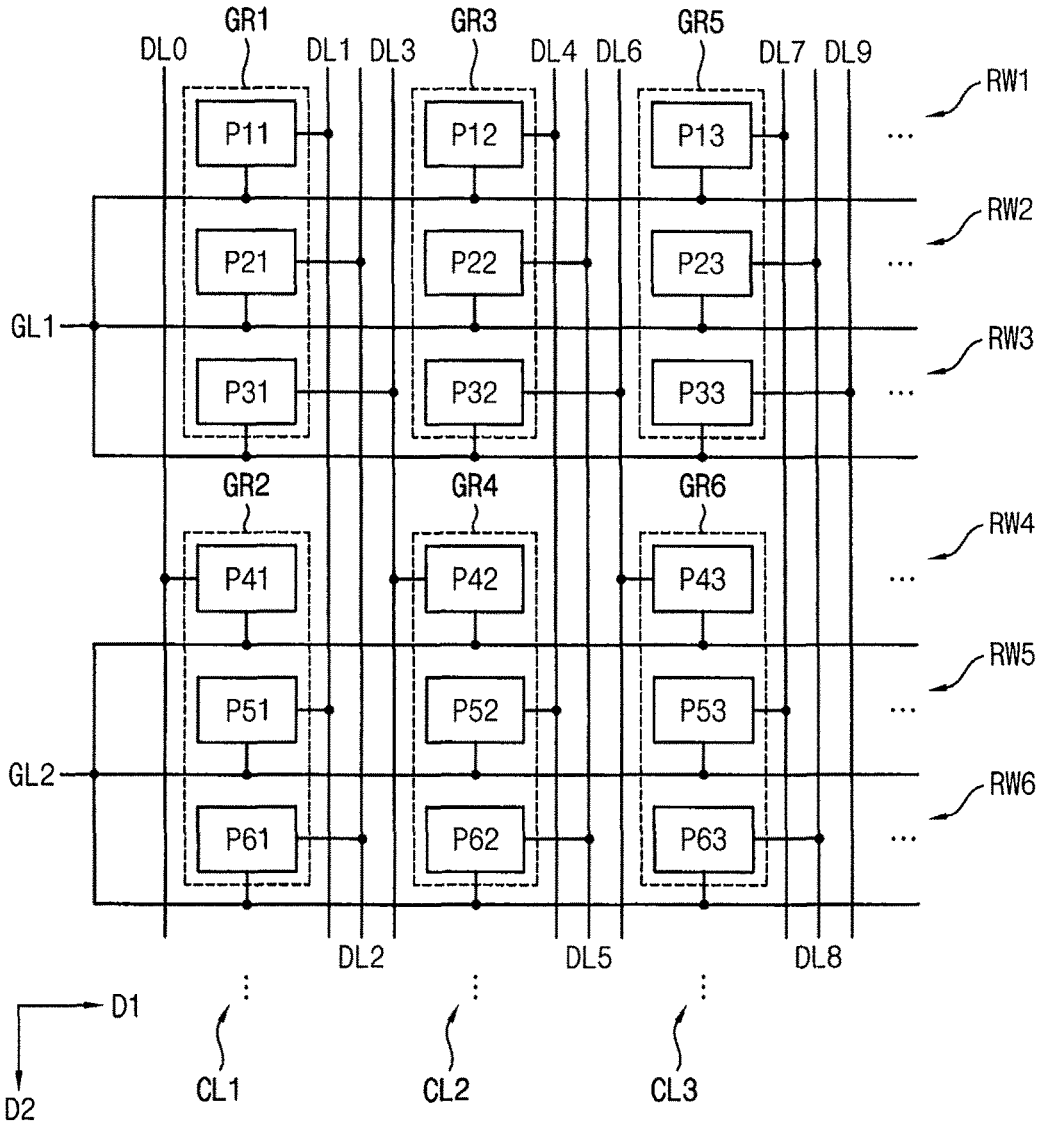
FIG. 3 is a plan view illustrating a display panel according to an exemplary embodiment of the present inventive concept.

FIG. 3 is a plan view illustrating a display panel according to an exemplary embodiment of the present inventive concept.

Referring to FIG. 3, a display panel includes a plurality of gate lines GL1 and GL2, a plurality of data lines DL0, DL1, DL2, DL3, DL4, DL5, DL6, DL7, DL8 and DL9, and a plurality of pixels P11, P21, P31, P41, P51, P61, P12, P22, P32, P42, P52, P62, P13, P23, P33, P43, P53 and P63. A portion of the display panel is illustrated in FIG. 3 for convenience of description.

The plurality of gate lines GL1 and GL2 extend in a first direction D1. A plurality of pixel rows RW1, RW2, RW3, RW4, RW5 and RW6 may be defined by the plurality of gate lines GL1 and GL2. The plurality of data lines DL0 through DL9 extend in a second direction D2 crossing the first direction D1. A plurality of pixel columns CL1, CL2 and CL3 may be defined by the plurality of data lines DL0 through DL9.

Each of the plurality of pixels P11 through P63 may be disposed in a respective one of the plurality of pixel rows RW1 through RW6 and a respective one of the plurality of pixel columns CL1 through CL3.

For example, the pixels P11, P21, P31, P41, P51 and P61 may be disposed in the first pixel column CL1. The pixels P12, P22, P32, P42, P52 and P62 may be disposed in the second pixel column CL2. The pixels P13, P23, P33, P43, P53 and P63 may be disposed in the third pixel column CL3.

The pixels P11, P12 and P13 may be disposed in the first pixel row RW1. The pixels P21, P22 and P23 may be disposed in the second pixel row RW2. The pixels P31, P32 and P33 may be disposed in the third pixel row RW3. The pixels P41, P42 and P43 may be disposed in the fourth pixel row RW4. The pixels P51, P52 and P53 may be disposed in the fifth pixel row RW5. The pixels P61, P62 and P63 may be disposed in the sixth pixel row RW6.

Each of the plurality of pixels P11 through P63 may be connected to a respective one of the plurality of gate lines GL1 and GL2 and a respective one of the plurality of data lines DL0 through DL9. Pixels disposed in three adjacent pixel rows may be connected to a single gate line. For example, three adjacent pixel rows may be driven by a single gate line. Some of the data lines DL1 through DL9 may be connected to some of the pixels P11 through P63 based on the non-alternate scheme, and the other of the data lines DL1 through DL9 may be connected to the other of the pixels P11 through P63 based on the alternate scheme.

A first pixel group GR1 includes three pixels P11, P21 and P31 (e.g., odd-numbered pixels) that are disposed in the first pixel column CL1 and are connected to the first gate line GL1. A second pixel group GR2 includes three pixels P41, P51 and P61 (e.g., odd-numbered pixels) that are disposed in the first pixel column CL1 and are connected to the second gate line GL2. The data line DL0 is connected to the second pixel group GR2 (e.g., the pixel P41) of the first and second pixel groups GR1 and GR2. For example, the data line DL0 is not connected to the first pixel group GR1. The data line DL3 is connected to the first pixel group GR1 (e.g., the pixel P31) of the first and second pixel groups GR1 and GR2. For example, the data line DL3 is not connected to the second pixel group GR2. Each of the data lines DL1 and DL2 (e.g., at least two data lines) other than the data lines DL0 and DL3 is connected to both the first and second pixel groups GR1 and GR2. The data lines DL1 and DL2 may be disposed between the data lines DL0 and DL3.

For example, the pixels P11, P21 and P31 included in the first pixel group GR1 and the pixels P41, P51 and P61 included in the second pixel group GR2 may be sequentially disposed in the second direction D2. The pixels P11 and P51 may be connected to the data line DL1. The pixels P21 and P61 may be connected to the data line DL2. The pixel P31 may be connected to the data line DL3. The pixel P41 may be connected to the data line DL0.

In addition, a third pixel group GR3 may include three pixels P12, P22 and P32 (e.g., odd-numbered pixels) that are disposed in the second pixel column CL2 and are connected to the first gate line GL1. A fourth pixel group GR4 may include three pixels P42, P52 and P62 (e.g., odd-numbered pixels) that are disposed in the second pixel column CL2 and are connected to the second gate line GL2. A fifth pixel group GR5 may include three pixels P13, P23 and P33 (e.g., odd-numbered pixels) that are disposed in the third pixel column CL3 and are connected to the first gate line GL1. A sixth pixel group GR6 may include three pixels P43, P53 and P63 (e.g., odd-numbered pixels) that are disposed in the third pixel column CL3 and are connected to the second gate line GL2.

The data line DL3 may be connected to the fourth pixel group GR4 (e.g., the pixel P42) of the third and fourth pixel groups GR3 and GR4. For example, the data line DL3 is not connected to the third pixel group GR3. The data line DL6 may be connected to the third pixel group GR3 (e.g., the pixel P32) of the third and fourth pixel groups GR3 and GR4. For example, the data line DL6 is not connected to the third pixel group GR3. Each of the data lines DL4 and DL5 (e.g., at least two data lines) other than the data lines DL3 and DL6 may be connected to both the third and fourth pixel groups GR3 and GR4. The data lines DL4 and DL5 may be disposed between the data lines DL3 and DL6. The data line DL6 may be connected to the sixth pixel group GR6 (e.g., the pixel P43) of the fifth and sixth pixel groups GR5 and GR6. For example, the data line DL6 is not connected to the fifth pixel group GR5. The data line DL9 may be connected to the fifth pixel group GR5 (e.g., the pixel P33) of the fifth and sixth pixel groups GR5 and GR6. For example, the data line DL9 is not connected to the sixth pixel group GR6. Each of the data lines DL7 and DL8 (e.g., at least two data lines) other than the data lines DL6 and DL9 may be connected to both the fifth and sixth pixel groups GR5 and GR6. The data lines DL7 and DL8 may be disposed between the data lines DL6 and DL9.

For example, the pixels P12, P22 and P32 included in the third pixel group GR3 and the pixels P42, P52 and P62 included in the fourth pixel group GR4 may be sequentially disposed in the second direction D2. The pixels P12 and P52 may be connected to the data line DL4. The pixels P22 and P62 may be connected to the data line DL5. The pixel P32 may be connected to the data line DL6. The pixel P42 may be connected to the data line DL3. The pixels P13, P23 and P33 included in the fifth pixel group GR5 and the pixels P43, P53 and P63 included in the sixth pixel group GR6 may be sequentially disposed in the second direction D2. The pixels P13 and P53 may be connected to the data line DL7. The pixels P23 and P63 may be connected to the data line DL8. The pixel P33 may be connected to the data line DL9. The pixel P43 may be connected to the data line DL6.

As described above, the pixels P11 and P51 connected to the data line DL1 may be disposed at a single side (e.g., a left side) with respect to the data line DL1. The pixels P21 and P61 connected to the data line DL2 may be disposed at a single side (e.g., a left side) with respect to the data line DL2. The pixels P31 and P42 connected to the data line DL3 may be disposed at both sides (e.g., both left and right sides) with respect to the data line DL3. For example, in the display panel of FIG. 3 according to an exemplary embodiment of the present inventive concept, the data lines DL1 and DL2 may be implemented based on the non-alternate scheme, and the data line DL3 may be implemented based on the alternate scheme. In addition, in the display panel of FIG. 3 according to an exemplary embodiment of the present inventive concept, the data lines DL4, DL5, DL7 and DL8 may be implemented based on the non-alternate scheme, and the data lines DL6 and DL9 may be implemented based on the alternate scheme. In addition, to drive the pixel P41 that is included in the first pixel column CL1 and is not connected to the data lines DL1, DL2 and DL3 (e.g., to have a structure of the display panel based on the non-alternate scheme and the alternate scheme), the display panel of FIG. 3 according to an exemplary embodiment of the present inventive concept may include the additional data line DL0 connected to the pixel P41.

Figure 4A:
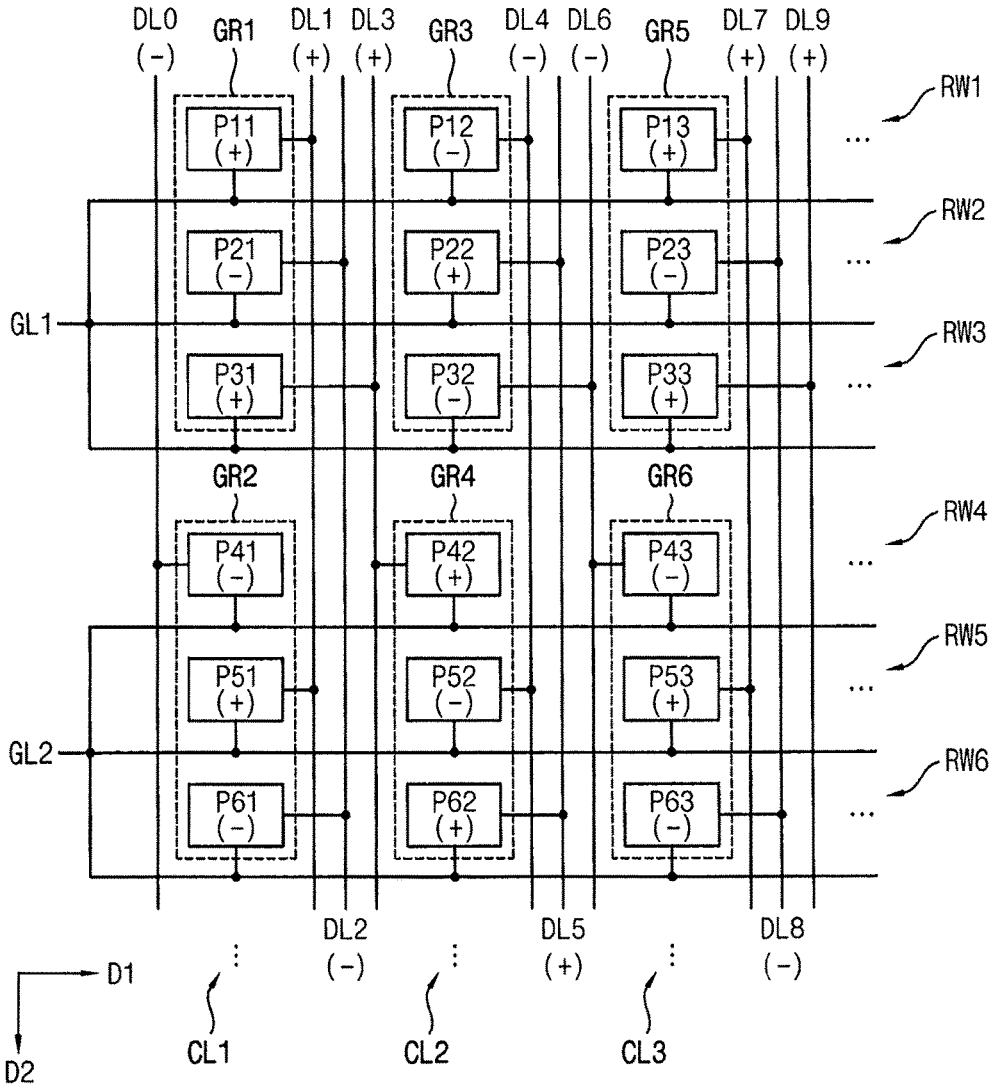
FIGS. 4A and 4B are diagrams for describing an operation of the display panel of FIG. 3 according to an exemplary embodiment of the present inventive concept.
Figure 4B:
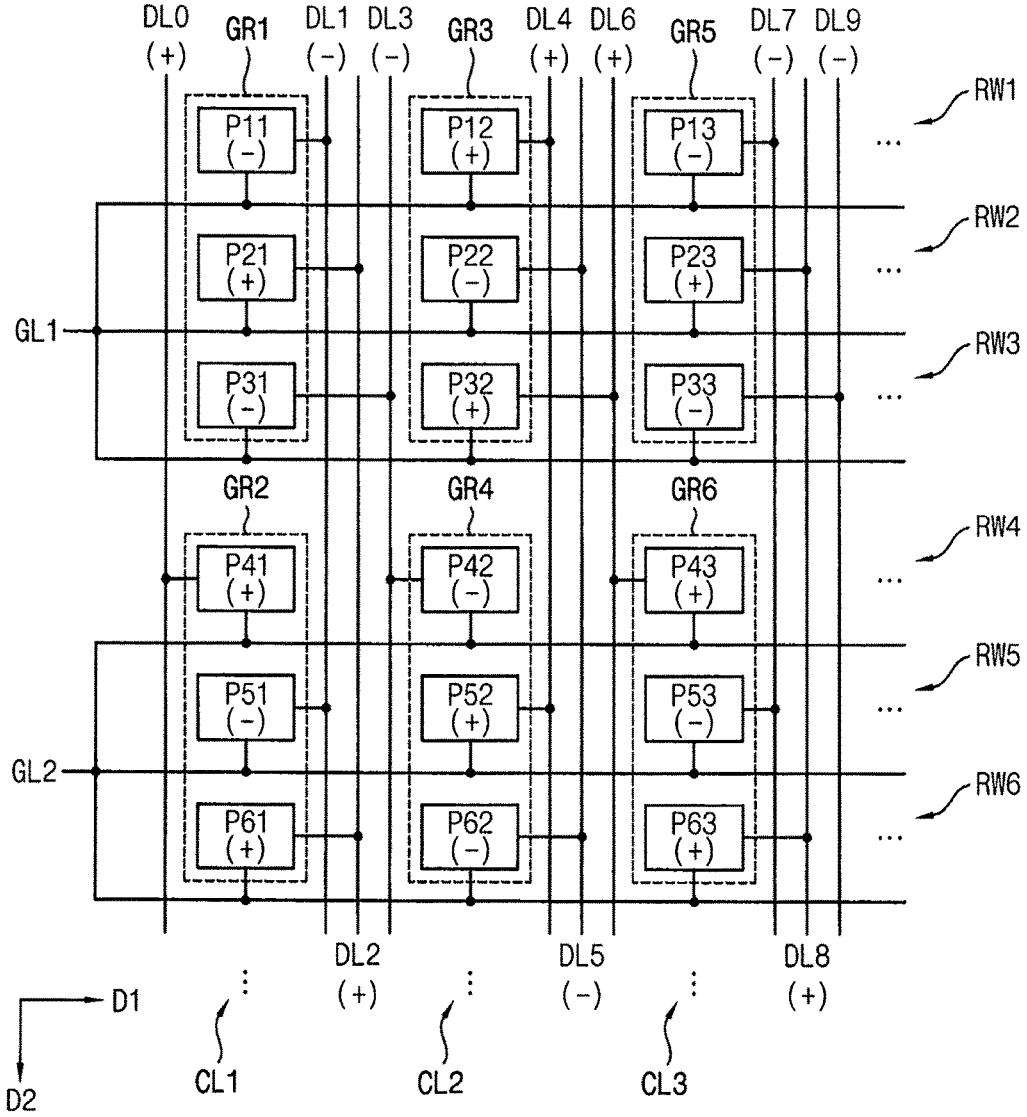

FIGS. 4A and 4B are diagrams for describing an operation of the display panel of FIG. 3 according to an exemplary embodiment of the present inventive concept.

As described above with reference to FIG. 1, the display panel according to an exemplary embodiment of the present inventive concept may operate based on the inversion driving scheme (e.g., a dot inversion driving scheme). For example, data voltages (e.g., analog data voltage signals) having a first polarity and data voltages having a second polarity different from the first polarity may be alternately applied to the plurality of data lines DL0 through DL9. Polarities of the data voltages may be inverted by a unit of frame.

For example, during a first frame, data voltages having a negative polarity (−) may be applied to the data lines DL0, DL2, DL4, DL6 and DL8, and data voltages having a positive polarity (+) may be applied to the data lines DL1, DL3, DL5, DL7 and DL9, as illustrated in FIG. 4A. During a first horizontal period of the first frame, the first gate line GL1 may be enabled (e.g., a first gate signal applied to the first gate line GL1 may be activated), the data voltages having the positive polarity may be applied to the pixels P11, P31, P22, P13 and P33, and the data voltages having the negative polarity may be applied to the pixels P21, P12, P32 and P23. During a second horizontal period of the first frame subsequent to the first horizontal period of the first frame, the second gate line GL2 may be enabled (e.g., a second gate signal applied to the second gate line GL2 may be activated), the data voltages having the positive polarity may be applied to the pixels P51, P42, P62 and P53, and the data voltages having the negative polarity may be applied to the pixels P41, P61, P52, P43 and P63.

During a second frame subsequent to the first frame, data voltages having the positive polarity may be applied to the data lines DL0, DL2, DL4, DL6 and DL8, and data voltages having the negative polarity may be applied to the data lines DL1, DL3, DL5, DL7 and DL9, as illustrated in FIG. 4B. During a first horizontal period of the second frame, the first gate line GL1 may be enabled, the data voltages having the negative polarity may be applied to the pixels P11, P31, P22, P13 and P33, and the data voltages having the positive polarity may be applied to the pixels P21, P12, P32 and P23. During a second horizontal period of the second frame subsequent to the first horizontal period of the second frame, the second gate line GL2 may be enabled, the data voltages having the negative polarity may be applied to the pixels P51, P42, P62 and P53, and the data voltages having the positive polarity may be applied to the pixels P41, P61, P52, P43 and P63.

In the display panel of FIG. 3 according to an exemplary embodiment of the present inventive concept, adjacent pixels may have different polarities from each other. For example, adjacent pixels that are disposed in boundaries of the pixel groups GR1 through GR6 may have different polarities from each other. For example, the pixel P31 in the first pixel group GR1 and the pixel P41, which is adjacent to the pixel P31, in the second pixel group GR2 may have different polarities from each other, the pixel P32 in the third pixel group GR3 and the pixel P42 in the fourth pixel group GR4 may have different polarities from each other, and the pixel P33 in the fifth pixel group GR5 and the pixel P43 in the sixth pixel group GR6 may have different polarities from each other. Accordingly, adjacent horizontal rows (e.g., the pixel rows RW3 and RW4) might not have the same polarity as each other, and thus, a horizontal spot line on the display panel may be prevented.

Figure 5:
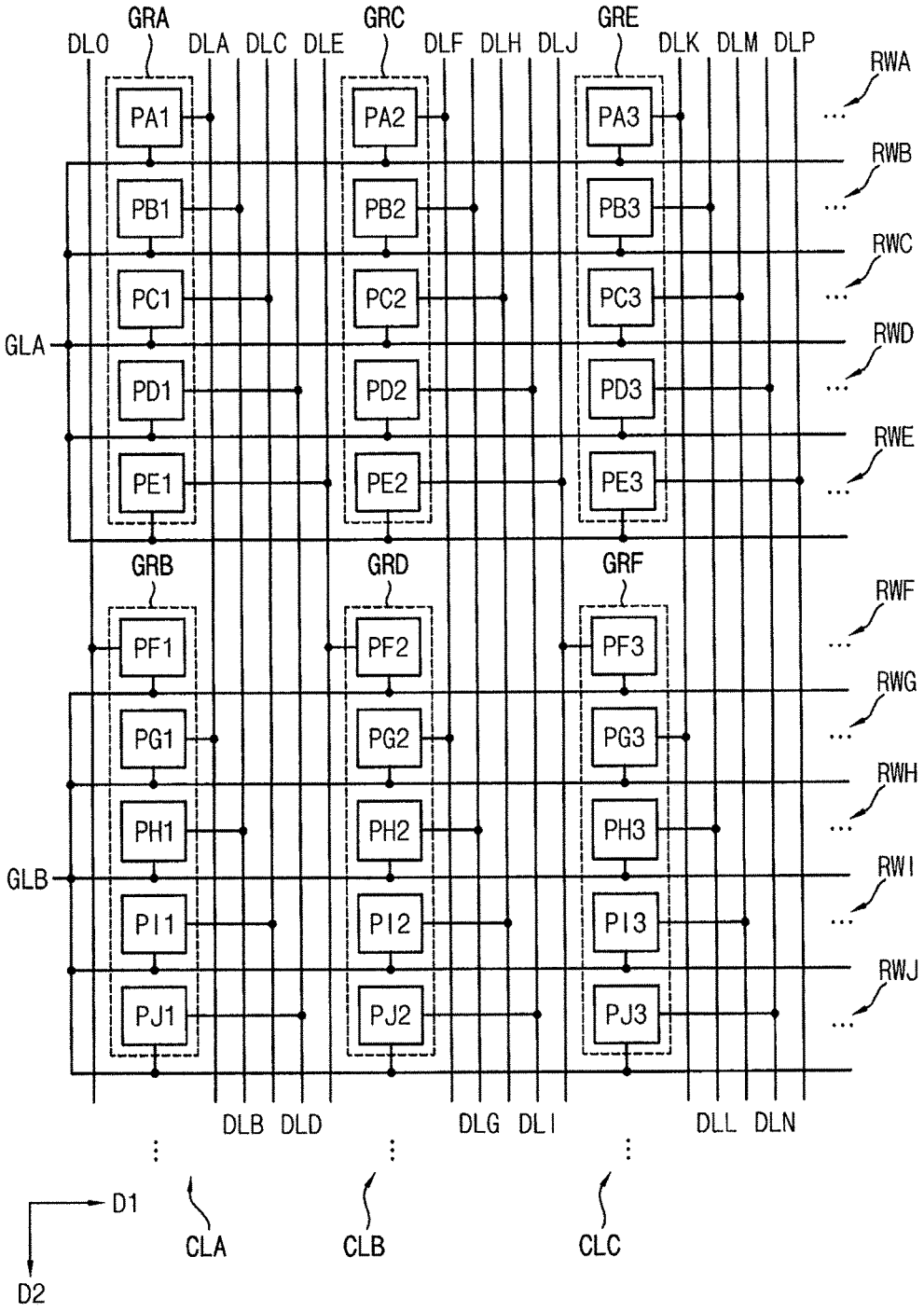
FIG. 5 is a plan view illustrating a display panel according to an exemplary embodiment of the present inventive concept.

FIG. 5 is a plan view illustrating a display panel according to an exemplary embodiment of the present inventive concept.

Referring to FIG. 5, the display panel includes a plurality of gate lines GLA and GLB, a plurality of data lines DL0, DLA, DLB, DLC, DLD, DLE, DLF, DLG, DLH, DLI, DLJ, DLK, DLL, DLM, DLN and DLP, and a plurality of pixels PA1, PB1, PC1, PD1, PE1, PF1, PG1, PH1, PI1, PJ1, PA2, PB2, PC2, PD2, PE2, PF2, PG2, PH2, PI2, PJ2, PA3, PB3, PC3, PD3, PE3, PF3, PG3, PH3, PI3 and PJ3. A portion of the display panel is illustrated in FIG. 5 for convenience of description, but the present inventive concept is limited thereto.

The plurality of gate lines GLA and GLB extends in a first direction D1. A plurality of pixel rows RWA, RWB, RWC, RWD, RWE, RWF, RWG, RWH, RWI and RWJ may be defined by the plurality of gate lines GLA and GLB. The plurality of data lines DL0 through DLP extends in a second direction D2 crossing the first direction D1. A plurality of pixel columns CLA, CLB and CLC may be defined by the plurality of data lines DL0 through DLP.

Each of the plurality of pixels PA1 through PJ3 may be disposed in a respective one of the plurality of pixel rows RWA through RWJ and a respective one of the plurality of pixel columns CLA through CLC.

For example, the pixels PA1, PB1, PC1, PD1, PE1, PF1, PG1, PH1, PI1 and PJ1 may be disposed in the first pixel column CLA. The pixels PA2, PB2, PC2, PD2, PE2, PF2, PG2, PH2, PI2 and PJ2 may be disposed in the second pixel column CLB. The pixels PA3, PB3, PC3, PD3, PE3, PF3, PG3, PH3, PI3 and PJ3 may be disposed in the third pixel column CLC.

The pixels PA1, PA2 and PA3 may be disposed in the first pixel row RWA. The pixels PB1, PB2 and PB3 may be disposed in the second pixel row RWB. The pixels PC1, PC2 and PC3 may be disposed in the third pixel row RWC. The pixels PD1, PD2 and PD3 may be disposed in the fourth pixel row RWD. The pixels PE1, PE2 and PE3 may be disposed in the fifth pixel row RWE. The pixels PF1, PF2 and PF3 may be disposed in the sixth pixel row RWF. The pixels PG1, PG2 and PG3 may be disposed in the seventh pixel row RWG. The pixels PH1, PH2 and PH3 may be disposed in the eighth pixel row RWH. The pixels PI1, PI2 and PI3 may be disposed in the ninth pixel row RWI. The pixels PJ1, PJ2 and PJ3 may be disposed in the tenth pixel row RWJ.

Each of the pixels PA1 through PJ3 may be connected to a respective one of the plurality of gate lines GLA and GLB and a respective one of the plurality of data lines DL0 through DLP. Pixels disposed in five adjacent pixel rows may be connected to a single gate line. Some of the data lines DLA through DLP may be connected to some of the pixels PA1 through PJ3 based on the non-alternate scheme, and the other of the data lines DLA through DLP may be connected to the other of the pixels PA1 through PJ3 based on the alternate scheme.

A first pixel group GRA includes five pixels PA1, PB1, PC1, PD1 and PE1 (e.g., odd-numbered pixels) that are disposed in the first pixel column CLA and are connected to the first gate line GLA. A second pixel group GRB includes five pixels PF1, PG1, PH1, PI1 and PJ1 (e.g., odd-numbered pixels) that are disposed in the first pixel column CLA and are connected to the second gate line GLB. The data line DL0 is connected to the second pixel group GRB (e.g., the pixel PF1) of the first and second pixel groups GRA and GRB. For example, the data line DL0 is not connected to the first pixel group GRA. The data line DLE is connected to the first pixel group GRA (e.g., the pixel PE1) of the first and second pixel groups GRA and GRB. For example, the data line DLE is not connected to the second pixel group GRB. Four data lines DLA, DLB, DLC and DLD (e.g., at least two data lines of the data lines DLA, DLB, DLC and DLD) other than the data lines DL0 and DLE are connected to both the first and second pixel groups GRA and GRB. The data lines DLA, DLB, DLC and DLD may be disposed between the data lines DL0 and DLE.

For example, the pixels PA1, PB1, PC1, PD1 and PE1 included in the first pixel group GRA and the pixels PF1, PG1, PH1, PI1 and PJ1 included in the second pixel group GRB may be sequentially disposed in the second direction D2. The pixels PA1 and PG1 may be connected to the data line DLA. The pixels PB1 and PH1 may be connected to the data line DLB. The pixels PC1 and PI1 may be connected to the data line DLC. The pixels PD1 and PJ1 may be connected to the data line DLD. The pixel PE1 may be connected to the data line DLE. The pixel PF1 may be connected to the data line DL0.

In addition, a third pixel group GRC may include five pixels PA2, PB2, PC2, PD2 and PE2 (e.g., odd-numbered pixels) that are disposed in the second pixel column CLB and are connected to the first gate line GLA. A fourth pixel group GRD may include five pixels PF2, PG2, PH2, PI2 and PJ2 (e.g., odd-numbered pixels) that are disposed in the second pixel column CLB and are connected to the second gate line GLB. A fifth pixel group GRE may include five pixels PA3, PB3, PC3, PD3 and PE3 (e.g., odd-numbered pixels) that are disposed in the third pixel column CLC and are connected to the first gate line GLA. A sixth pixel group GRF may include five pixels PF3, PG3, PH3, PI3 and PJ3 (e.g., odd-numbered pixels) that are disposed in the third pixel column CLC and are connected to the second gate line GLB.

The data line DLE may be connected to the fourth pixel group GRD (e.g., the pixel PF2) of the third and fourth pixel groups GRC and GRD. For example, the data line DLE might not be connected to the third pixel group GRC. The data line DLJ may be connected to the third pixel group GRC (e.g., the pixel PE2) of the third and fourth pixel groups GRC and GRD. For example, the data line DLJ might not be connected to the fourth pixel group GRD. Four data lines DLF, DLG, DLH and DLI (e.g., at least two data lines) other than the data lines DLE and DLJ may be connected to both the third and fourth pixel groups GRC and GRD. The data lines DLF, DLG, DLH and DLI may be disposed between the data lines DLE and DLJ. The data line DLJ may be connected to the sixth pixel group GRF (e.g., the pixel PF3) of the fifth and sixth pixel groups GRE and GRF. For example, the data line DLJ might not be connected to the fifth pixel group GRE. The data line DLP may be connected to the fifth pixel group GRE (e.g., the pixel PE3) of the fifth and sixth pixel groups GRE and GRF. For example, the data line DLP might not be connected to the sixth pixel group GRF. Four data lines DLK, DLL, DLM and DLN (e.g., at least two data lines of the data lines DLK, DLL, DLM and DLN) other than the data lines DLJ and DLP may be connected to both the fifth and sixth pixel groups GRE and GRF. The data lines DLK, DLL, DLM and DLN may be disposed between the data lines DLJ and DLP.

For example, the pixels PA2, PB2, PC2, PD2 and PE2 included in the third pixel group GRC and the pixels PF2, PG2, PH2, PI2 and PJ2 included in the fourth pixel group GRD may be sequentially disposed in the second direction D2. The pixels PA2 and PG2 may be connected to the data line DLF. The pixels PB2 and PH2 may be connected to the data line DLG. The pixels PC2 and PI2 may be connected to the data line DLH. The pixels PD2 and PJ2 may be connected to the data line DLI. The pixel PE2 may be connected to the data line DLJ. The pixel PF2 may be connected to the data line DLE. The pixels PA3, PB3, PC3, PD3 and PE3 included in the fifth pixel group GRE and the pixels PF3, PG3, PH3, PI3 and PJ3 included in the sixth pixel group GRF may be sequentially disposed in the second direction D2. The pixels PA3 and PG3 may be connected to the data line DLK. The pixels PB3 and PH3 may be connected to the data line DLL. The pixels PC3 and PI3 may be connected to the data line DLM. The pixels PD3 and PJ3 may be connected to the data line DLN. The pixel PE3 may be connected to the data line DLP. The pixel PF3 may be connected to the data line DLJ.

As described above, in the display panel of FIG. 5 according to an exemplary embodiment of the present inventive concept, the data lines DLA, DLB, DLC, DLD, DLF, DLG, DLH, DLI, DLK, DLL, DLM and DLN may be implemented based on the non-alternate scheme, and the data lines DLE, DLJ and DLP may be implemented based on the alternate scheme. In addition, to drive the pixel PF1 that is included in the first pixel column CLA and is not connected to the data lines DLA, DLB, DLC, DLD and DLE (e.g., to have a structure of the display panel based on the non-alternate scheme and the alternate scheme), the display panel of FIG. 5 according to an exemplary embodiment of the present inventive concept may include the additional data line DL0 connected to the pixel PF1.

Figure 6A:
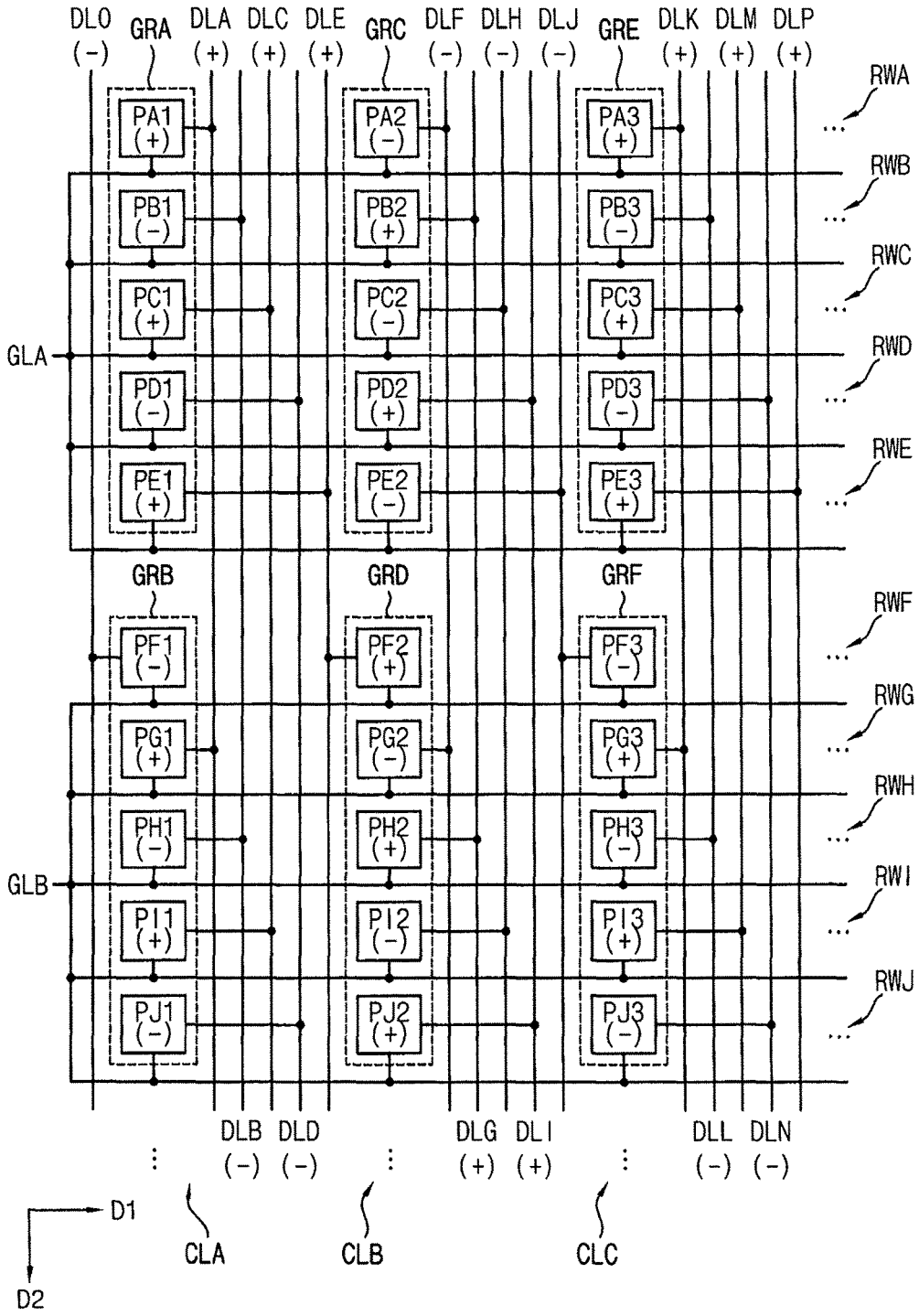
FIGS. 6A and 6B are diagrams for describing an operation of the display panel of FIG. 5 according to an exemplary embodiment of the present inventive concept.
Figure 6B:
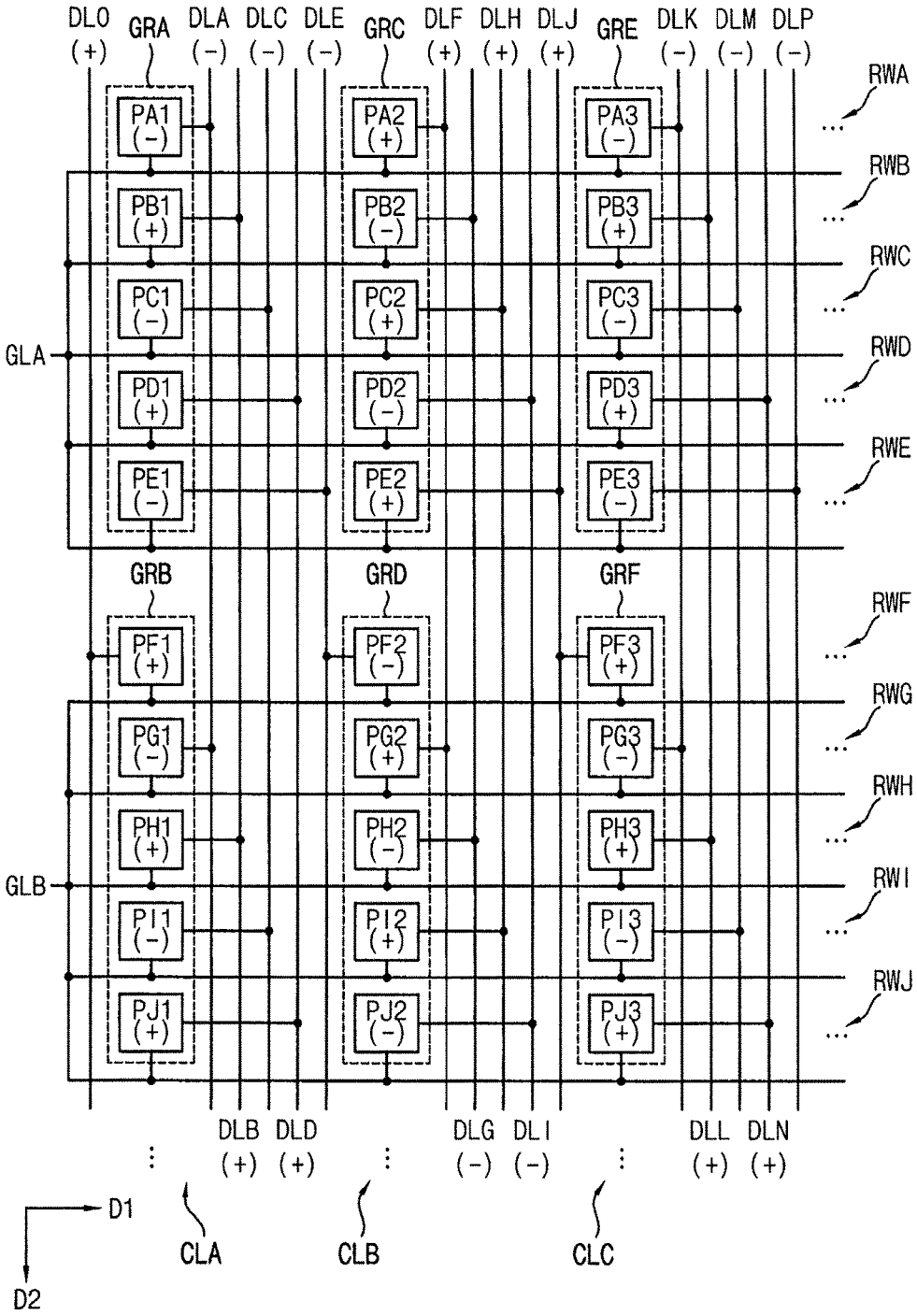

FIGS. 6A and 6B are diagrams for describing an operation of the display panel of FIG. 5 according to an exemplary embodiment of the present inventive concept.

As described above with reference to FIG. 1, the display panel according to an exemplary embodiment of the present inventive concept may operate based on the inversion driving scheme (e.g., the dot inversion driving scheme). For example, data voltages (e.g., analog data voltage signals) having a first polarity and data voltages having a second polarity different from the first polarity may be alternately applied to the plurality of data lines DL0 through DLP. Polarities of the data voltages may be inverted by a unit of frame.

For example, during a first frame, data voltages having a negative polarity (−) may be applied to the data lines DL0, DLB, DLD, DLF, DLH, DLJ, DLL and DLN, and data voltages having a positive polarity (+) may be applied to the data lines DLA, DLC, DLE, DLG, DLI, DLK, DLM and DLP, as illustrated in FIG. 6A. During a first horizontal period of the first frame, the first gate line GLA may be enabled (e.g., a first gate signal applied to the first gate line GLA may be activated), the data voltages having the positive polarity may be applied to the pixels PA1, PC1, PE1, PB2, PD2, PA3, PC3 and PE3, and the data voltages having the negative polarity may be applied to the pixels PB1, PD1, PA2, PC2, PE2, PB3 and PD3. During a second horizontal period of the first frame subsequent to the first horizontal period of the first frame, the second gate line GLB may be enabled (e.g., a second gate signal applied to the second gate line GLB may be activated), the data voltages having the positive polarity may be applied to the pixels PG1, PI1, PF2, PH2, PJ2, PG3 and PI3, and the data voltages having the negative polarity may be applied to the pixels PF1, PH1, PJ1, PG2, PI2, PF3, PH3 and PJ3.

During a second frame subsequent to the first frame, data voltages having the positive polarity may be applied to the data lines DL0, DLB, DLD, DLF, DLH, DLJ, DLL and DLN, and data voltages having the negative polarity may be applied to the data lines DLA, DLC, DLE, DLG, DLI, DLK, DLM and DLP, as illustrated in FIG. 6B. During a first horizontal period of the second frame, the first gate line GLA may be enabled, the data voltages having the negative polarity may be applied to the pixels PA1, PC1, PE1, PB2, PD2, PA3, PC3 and PE3, and the data voltages having the positive polarity may be applied to the pixels PB1, PD1, PA2, PC2, PE2, PB3 and PD3. During a second horizontal period of the second frame subsequent to the first horizontal period of the second frame, the second gate line GLB may be enabled, the data voltages having the negative polarity may be applied to the pixels PG1, PI1, PF2, PH2, PJ2, PG3 and PI3, and the data voltages having the positive polarity may be applied to the pixels PF1, PH1, PJ1, PG2, PI2, PF3, PH3 and PJ3.

In the display panel of FIG. 5 according to an exemplary embodiment of the present inventive concept, adjacent pixels may have different polarities from each other. For example, adjacent pixels that are disposed in boundaries of the pixel groups GRA through GRF may have different polarities from each other. For example, the pixel PE1 in the first pixel group GRA and the pixel PF1 in the second pixel group GRB may have different polarities from each other, the pixel PE2 in the third pixel group GRC and the pixel PF2 in the fourth pixel group GRD may have different polarities from each other, and the pixel PE3 in the fifth pixel group GRE and the pixel PF3 in the sixth pixel group GRF may have different polarities from each other. Accordingly, adjacent horizontal rows (e.g., pixel rows RWE and RWF) might not have the same polarity as each other, and thus, a horizontal spot line on the display panel may be prevented.

In some exemplary embodiment of the present inventive concept, when the display panel 100 has an RGB structure, the plurality of pixels (e.g., the pixels P11 through P63 in FIG. 3 or the pixels PA1 through PJ3 in FIG. 5) may include a red pixel outputting a red light, a green pixel outputting a green light and a blue pixel outputting a blue light.

In some exemplary embodiment of the present inventive concept, when the display panel 100 has an RGBW structure, the plurality of pixels (e.g., the pixels P11 through P63 in FIG. 3 or the pixels PA1 through PJ3 in FIG. 5) may include a red pixel outputting a red light, a green pixel outputting a green light, a blue pixel outputting a blue light and a white pixel outputting a white light.

Although the exemplary embodiment of the present inventive concept are described based on the examples where three or five adjacent horizontal rows are driven by a single gate line, the exemplary embodiment of the present inventive concept will be employed to an example where any odd-numbered adjacent horizontal rows are driven by a single gate line. Although the exemplary embodiment of the present inventive concept are described based on the example of the non-alternate scheme where pixels connected to one data line are disposed at only left side with respect to the one data line, the exemplary embodiment of the present inventive concept will be employed to an example of the non-alternate scheme where pixels connected to one data line are disposed at only right side with respect to the one data line.

The above described embodiments may be used in a display panel, a display apparatus and/or a system including the display apparatus, such as a mobile phone, a smart phone, a personal digital assistants (PDA), a portable multimedia player (PMP), a digital camera, a digital television, a set-top box, a music player, a portable game console, a navigation device, a personal computer (PC), a server computer, a workstation, a tablet computer, a laptop computer, a smart card, a printer, etc.

The foregoing is illustrative of exemplary embodiment of the present inventive concept and the present inventive concept should not be construed as being limited. Although a few exemplary embodiment of the present inventive concept have been described, it will be understood that many modifications in form and details may be made therein without departing from the spirit and scope of the present inventive concept.

What is claimed is:

1. A display panel comprising:

a plurality of gate lines extending in a first direction, the plurality of gate lines including a first gate line and a second gate line that are adjacent to each other;

a plurality of data lines extending in a second direction crossing the first direction, the plurality of data lines including a first data line, a second data line, a third data line, and a fourth data line; and a plurality of pixels each of which is connected to one of the plurality of gate lines and one of the plurality of data lines, the plurality of pixels including first odd-numbered pixels connected to the first gate line, second odd-numbered pixels connected to the second gate line, third odd-numbered pixels connected to the first gate line, and fourth odd-numbered pixels connected to the second gate line, wherein the first and second odd-numbered pixels are disposed in a first pixel column of the plurality of pixels, and the third and fourth odd-numbered pixels are disposed in a second pixel column of the plurality of pixels, wherein the first data line is connected to a first any one of the second odd-numbered pixels and is not connected to any one of the first odd-numbered pixels, wherein the second data line is connected to a first any one of the first odd-numbered pixels and a first any one of the fourth odd-numbered pixels, and is not connected to any one of the second odd-numbered pixels and any one of the third odd-numbered pixels, wherein the third data line is connected to a second any one of the first odd-numbered pixels and a second any one of the second odd-numbered pixels, and wherein the fourth data line is connected to a first any one of the third odd-numbered pixels and is not connected to any one of the fourth odd-numbered pixels.

2. The display panel of claim 1, wherein the plurality of data lines further includes a fifth data line, wherein the fifth data line is connected to a second any one of the third odd-numbered pixels and a second any one of the fourth odd-numbered pixels.

3. A display panel comprising:

a plurality of gate lines extending in a first direction, the plurality of gate lines including a first gate line and a second gate line that are adjacent to each other;

a plurality of data lines extending in a second direction crossing the first direction, the plurality of data lines including a first data line, a second data line, and a third data line; and a plurality of pixels each of which is connected to at least one of the plurality of gate lines and at least one of the plurality of data lines, wherein the first data line is connected to at least a first any one of a second plurality of pixels in a first pixel column of the plurality of pixels, wherein the second data line is connected to at least a first any one of a first plurality of pixels in the first pixel column, and wherein the third data line is connected to at least a second any one of the first plurality of pixels and at least a second any one of the second plurality of pixels, wherein the plurality of data lines further includes a fourth data line, wherein the third data line and the fourth data line are disposed between the first and second data lines, wherein the first plurality of pixels includes a first pixel, a second pixel, and a third pixel that are sequentially disposed in the second direction, and the second plurality of pixels includes a fourth pixel, a fifth pixel, and a sixth pixel that are sequentially disposed in the second direction, wherein the first and fifth pixels are connected to the third data line, wherein the second and sixth pixels are connected to the fourth data line, wherein the third pixel is connected to the second data line, and wherein the fourth pixel is connected to the first data line.

4. The display panel of claim 3, wherein the third pixel and the fourth pixel are adjacent to each other, and a first data voltage applied to the third pixel has a polarity different from a polarity of a second data voltage applied to the fourth pixel.

5. The display panel of claim 3, wherein data voltages having a first polarity are applied to the first data line and the fourth data line, wherein data voltages having a second polarity different from the first polarity are applied to the second data line and the third data line.

6. The display panel of claim 5, wherein the first polarity is a positive polarity with respect to a common voltage, and the second polarity is a negative polarity with respect to the common voltage.

7. The display panel of claim 5, wherein the first polarity is a negative polarity with respect to a common voltage, and the second polarity is a positive polarity with respect to the common voltage.

8. A display panel comprising:

a plurality of gate lines extending in a first direction, the plurality of gate lines including a first gate line and a second gate line that are adjacent to each other;

a plurality of data lines extending in a second direction crossing the first direction, the plurality of data lines including a first data line, a second data line, and a third data line; and a plurality of pixels each of which is connected to at least one of the plurality of gate lines and at least one of the plurality of data lines, wherein the first data line is connected to at least a first any one of a second plurality of pixels in a first pixel column of the plurality of pixels, wherein the second data line is connected to at least a first any one of a first plurality of pixels in the first pixel column, and wherein the third data line is connected to at least a second any one of the first plurality of pixels and at least a second any one of the second plurality of pixels, wherein the plurality of data lines further includes a fourth data line, a fifth data line, and a sixth data line, wherein the third, seventh, eighth, and ninth data lines are disposed between the first and second data lines, wherein the first plurality of pixels includes a first pixel, a second pixel, a third pixel, a fourth pixel, and a fifth pixel that are sequentially disposed in the second direction, and the second plurality of pixels includes a sixth pixel, a seventh pixel, an eighth pixel, a ninth pixel, and a tenth pixel that are sequentially disposed in the second direction, wherein the first and seventh pixels are connected to the third data line, wherein the second and eighth pixels are connected to the fourth data line, wherein the third and ninth pixels are connected to the fifth data line, wherein the fourth and tenth pixels are connected to the sixth data line, wherein the fifth pixel is connected to the second data line, and wherein the sixth pixel is connected to the first data line.

9. The display panel of claim 1, wherein the plurality of pixels includes a red pixel outputting a red light, a green pixel outputting a green light, and a blue pixel outputting a blue light.

10. A display apparatus comprising:

a timing controller configured to control an operation of a display panel and to generate output image data based on input image data; and a display panel configured to display an image based on the output image data, the display panel comprising:

a plurality of gate lines extending in a first direction, the plurality of gate lines including a first gate line and a second gate line that are adjacent to each other;

a plurality of data lines extending in a second direction crossing the first direction, the plurality of data lines including a first data line, a second data line, a third data line, and a fourth data line; and a plurality of pixels each of which is connected to one of the plurality of gate lines and one of the plurality of data lines, the plurality of pixels including first odd-numbered pixels connected to the first gate line and second odd-numbered pixels connected to the second gate line, wherein the first and second odd-numbered pixels are disposed in a first pixel column of the plurality of pixels, wherein the first data line is connected to a first any one of the second odd-numbered pixels and is not connected to any one of the first odd-numbered pixels, wherein the second data line is connected to a first any one of the first odd-numbered pixels and is not connected to any one of the second odd-numbered pixels, wherein the third data line is connected to a second any one of the first odd-numbered pixels and a second any one of the second odd-numbered pixels, wherein the fourth data line is connected to a third any one of the first odd-numbered pixels and a third any one of the second odd-numbered pixels, and wherein the third data line and the fourth data line are disposed between the first and second data lines.

11. The display apparatus of claim 10, wherein the plurality of data lines further includes a fifth data line and a sixth data line, wherein the plurality of pixels further includes third odd-numbered pixels connected to the first gate line and fourth odd-numbered pixels connected to the second gate line, wherein the third and fourth odd-numbered pixels are disposed in a second pixel column of the plurality of pixels, wherein the second data line is connected to a first any one of the fourth odd-numbered pixels and is not connected to any one of the third odd-numbered pixels, wherein the sixth data line is connected to a first any one of the third odd-numbered pixels and is not connected to any one of the fourth odd-numbered pixels, and wherein the fifth data line is connected to a second any one of the third odd-numbered pixels and a second any one of the fourth odd-numbered pixels.

12. The display apparatus of claim 10, wherein the first odd-numbered pixels includes a first pixel, a second pixel, and a third pixel that are sequentially disposed in the second direction, and the second odd-numbered pixels includes a fourth pixel, a fifth pixel, and a sixth pixel that are sequentially disposed in the second direction, wherein the first and fifth pixels are connected to the third data line, wherein the second and sixth pixels are connected to the fourth data line, wherein the third pixel is connected to the second data line, and wherein the fourth pixel is connected to the first data line.

13. The display apparatus of claim 12, wherein the third pixel and the fourth pixel are adjacent to each other, and a first data voltage applied to the third pixel has a polarity different from a polarity of a second data voltage applied to the fourth pixel.

14. The display apparatus of claim 12, wherein data voltages having a first polarity are applied to the first data line and the fourth data line, wherein data voltages having a second polarity different from the first polarity are applied to the second data line and the third data line.

15. The display apparatus of claim 14, wherein the first polarity is a positive polarity with respect to a common voltage, and the second polarity is a negative polarity with respect to the common voltage.

16. The display apparatus of claim 14, wherein the first polarity is a negative polarity with respect to a common voltage, and the second polarity is a positive polarity with respect to the common voltage.

17. The display apparatus of claim 10, wherein the plurality of data lines further includes a fifth data line, and a sixth data line, wherein the third, seventh, eighth, and ninth data lines are disposed between the first and second data lines, wherein the first odd-numbered pixels includes a first pixel, a second pixel, a third pixel, a fourth pixel, and a fifth pixel that are sequentially disposed in the second direction, and the second odd-numbered pixels includes a sixth pixel, a seventh pixel, an eighth pixel, a ninth pixel, and a tenth pixel that are sequentially disposed in the second direction, wherein the first and seventh pixels are connected to the third data line, wherein the second and eighth pixels are connected to the fourth data line, wherein the third and ninth pixels are connected to the fifth data line, wherein the fourth and tenth pixels are connected to the sixth data line, wherein the fifth pixel is connected to the second data line, and wherein the sixth pixel is connected to the first data line.

18. The display apparatus of claim 10, further comprising:

a gate driver connected to the plurality of gate lines, the gate driver configured to generate a plurality of gate signals to be applied to the display panel.

19. The display apparatus of claim 10, further comprising:

a data driver connected to the plurality of data lines, the data driver configured to generate a plurality of data voltages based on the output image data to be applied to the display panel.

* * * * *